US005515766A

United States Patent [19]

Fleury

[11] Patent Number: 5,515,766

[45] Date of Patent: May 14, 1996

[54] CARTRIDGE RE-SIZING APPARATUS

[75] Inventor: Michael F. Fleury, Elgin, Ill.

[73] Assignee: Image Industries, Inc., Wooddale, Ill.

[21] Appl. No.: 469,231

[22] Filed: Jun. 6, 1995

[51] Int. Cl.[6] ..... F42B 33/10

[52] U.S. Cl. ..... 86/23; 29/1.3; 72/90; 86/24; 86/36; 86/44; 86/46

[58] Field of Search ..... 86/1.1, 10, 23–28, 86/36–38, 44–46; 29/1.3, 1.31; 72/88, 90

[56] References Cited

U.S. PATENT DOCUMENTS

| | | | |
|---|---|---|---|
| 742,768 | 10/1903 | Wetzig . | |
| 1,474,355 | 11/1923 | Fraser . | |
| 1,718,107 | 6/1929 | Bond . | |
| 2,031,850 | 2/1936 | Peterson . | |
| 2,133,198 | 10/1938 | Jayne . | |
| 2,571,272 | 10/1951 | Martin . | |
| 2,748,648 | 6/1956 | Miller . | |
| 2,755,839 | 7/1956 | Garrock et al. . | |
| 2,825,259 | 3/1958 | Novak . | |
| 3,705,515 | 12/1972 | Lee | 29/1.3 |
| 4,133,249 | 1/1979 | Bachhuber | 86/23 |
| 5,309,813 | 5/1994 | Henley | 86/23 |

*Primary Examiner*—Harold J. Tudor
*Attorney, Agent, or Firm*—Cook, Egan, McFarron & Manzo, Ltd.

[57] ABSTRACT

Disclosed is a machine for re-sizing spent ammunition cartridges, such as spent brass cartridges for hand guns. A pair of forming rails which move with respect to one another to roll the cartridge between the rails in order to restore the cartridge to the original cylindrical specifications. The forming surface of one of the forming rails includes an inclined step which lengthens the cartridge as the bulge is rolled out of the cartridge neck.

10 Claims, 6 Drawing Sheets

CARTRIDGE RE-SIZING APPARATUS

The present invention relates to a machine for re-sizing spent ammunition cartridges, such as spent brass cartridges for hand guns.

Modern weapons and particularly, semi-automatic and select fire weapons, require ammunition which meets rigorous size and standards in order for the weapons to function properly and fire any reproducible matter. The size configuration for ammunition for different weapons is set out by Small Arms Manufacturing Institute (S.A.M.I.).

During the firing of fixed ammunition, the cartridge is expanded by the gases from the ignited propellant. The expansion of the cartridge forms a seal within the chamber of the weapon (called obturation) to form a seal. The seal formed by the obturation process prevents gas from the burning propellant from moving rearwardly in the chamber and thus confines all of the gases formed behind the projectile to propel the projectile from the weapon.

In many weapons, the configuration of the chamber is such that the expansion of the cartridge near the rim is not restrained and consequently during the firing of the weapon the expansion of the cartridge at the neck forms a bulge adjacent to the rim of the cartridge. The bulge in the neck of the cartridge is a serious problem in reloading the cartridge for reuse. This bulge in the neck not only changes the outer diameter of the cartridge but it tends to shorten the length of the cartridge. The expansion which creates the bulge also tends to distort the primer pocket making reloading of the cartridges difficult.

Cartridges which have bulges along the side or which are too short do not meet S.A.M.I. specifications. If such cartridges are reloaded, they do not produce reproducible firing and have a tendency to jam in the weapons, when reuse is attempted.

The machine of the present invention is designed to roll the used cartridge to remove the bulge out of the lower portion of the cartridge neck and to restore the diameter of the cylinder to the S.A.M.I. specifications, and at the same time in the same rolling operation to lengthen the cartridge to the specified length. Additionally, the rolling operation also will tighten up the primer pocket and smooths out the rim and any damage to the extractor groove.

The machine of the present invention comprises a pair of forming rails which move with respect to one another to roll the cartridge between the rails in order to restore the cartridge to the original cylindrical specifications. The forming surface of one of the forming rails includes a surface silhouette which matches the silhouette of the cartridge being re-sized so that the forming rail engages the cartridge in the desired position for rolling. The forming surface of one of the forming rails includes an inclined step which starts at the extractor groove near the cartridge pick-up point and which inclines upwardly toward the mouth of the cartridge near the cartridge release point. The step lengthens the cartridge as the bulge is rolled out of the cartridge neck. Thus, the machine of the present invention not only re-sizes the diameter of the cartridge to the original specification, but in the same motion, re-lengthens the cartridge to the original specification.

DETAILED DESCRIPTION OF THE PRESENT INVENTION

Figure 1:
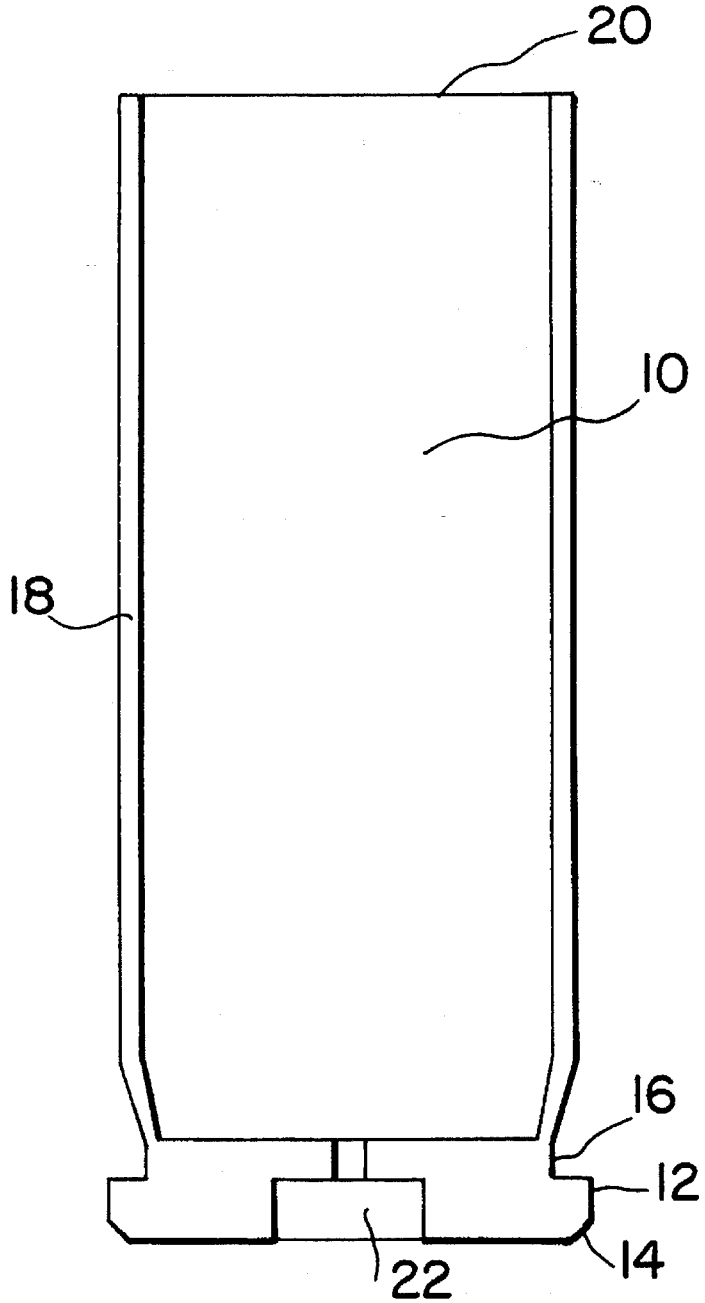
FIG. 1 is a cross-sectional side view of a conventional pistol cartridge.

The cartridge re-sizing machine of the present invention is designed to correct the distortion of cartridges of the type shown in FIG. 1. FIG. 1 illustrates a typical ammunition cartridge of the type used in hand held pistols. Basically, the cartridge 10 is a brass cylinder which includes rim 12, rim chamfer 14, extractor groove 16, neck 18 and mouth 20. Also shown is the primer pocket 22. During firing, cartridges typically expand radially and frequently a bulge is formed in the neck 18 adjacent to the extractor groove 16. The formation of a bulge tends to reduce the length of the cartridge and to expand the rim 12 which causes the primer pocket 22 to become enlarged.

Figure 2:
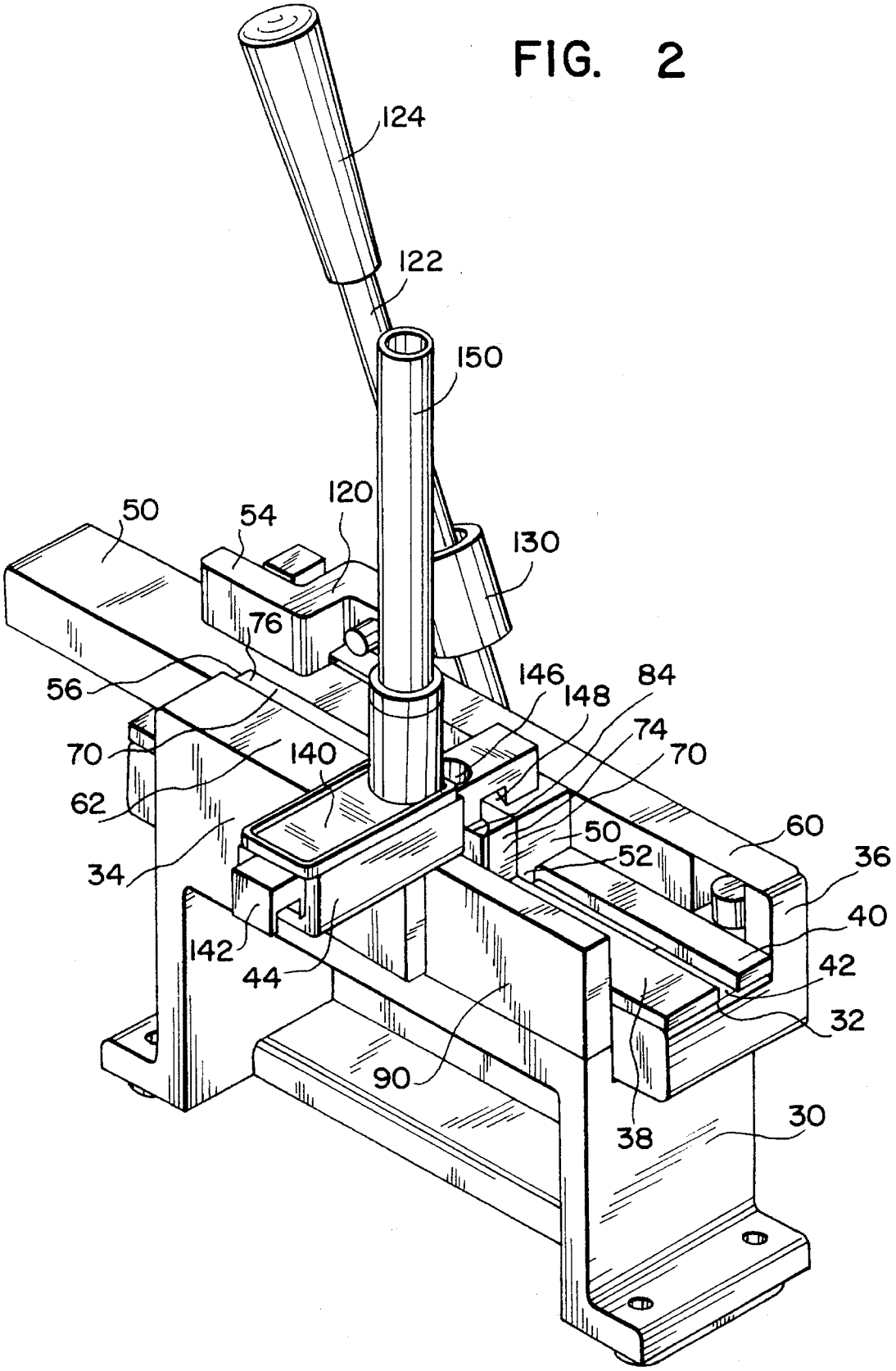
FIG. 2 is an isometric view of the machine of the present invention at the cartridge pick-up position.
Figure 3:
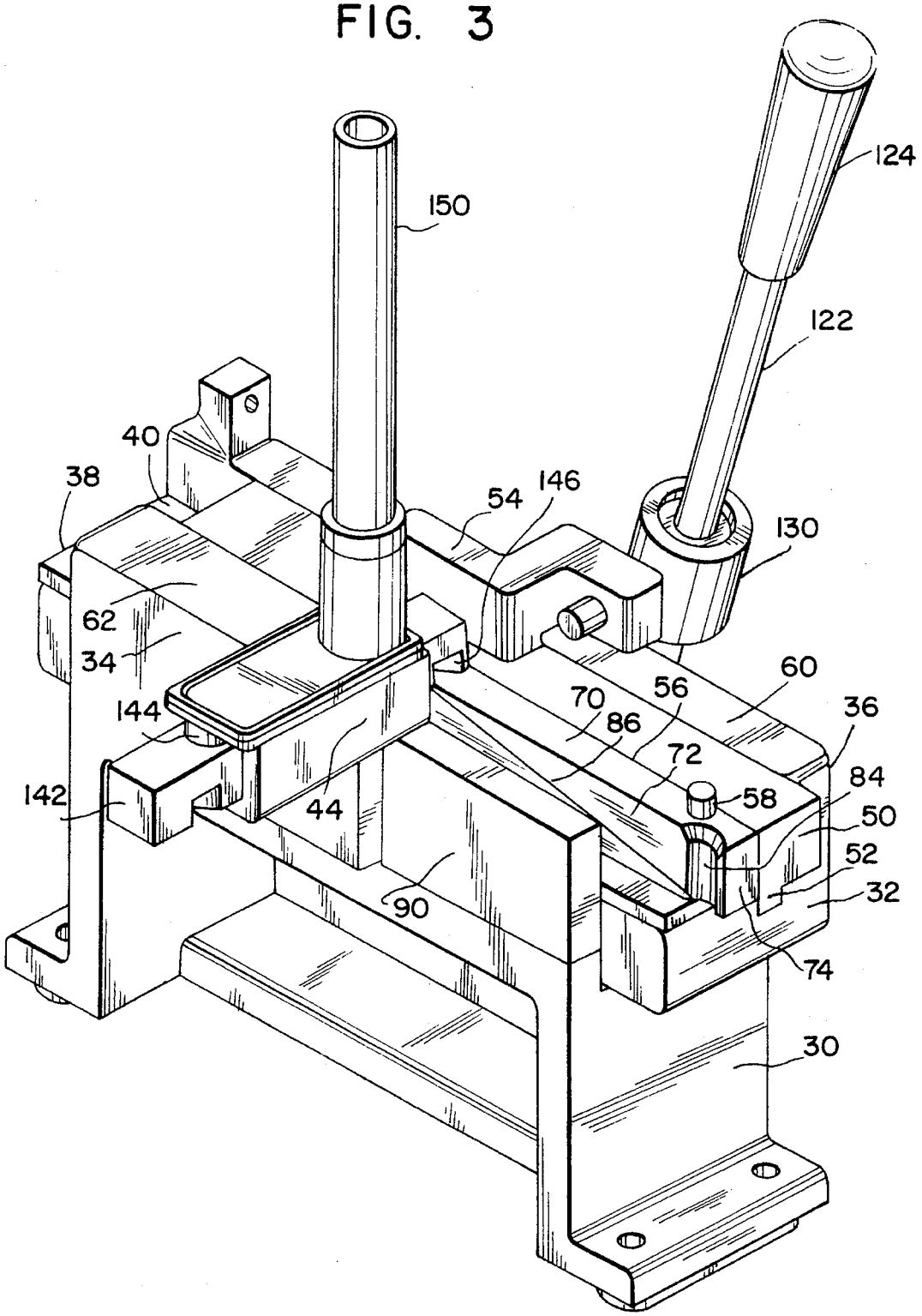
FIG. 3 is an isometric view of the machine of the present invention during the cartridge rolling step.

The cartridge re-sizing machine of the present invention is shown generally in FIGS. 2 and 3. The cartridge re-sizing machine generally includes a base 30 on which the machine rests. One of the forming rails 90 is fixed to base 30. A slide 50, which carries the second forming rail 70, is positioned on base 30 in a manner that allows relative movement between the rails to roll a cartridge, preferably for at least three turns, during which the cartridge is re-sized. Generally, the cartridge re-sizing apparatus also includes drive assembly 120 to move slide 50 and cartridge feed assembly 140 to feed used cartridges to the rails for re-sizing. FIG. 2 shows the machine at the cartridge pick-up position, that is the point in the operational cycle where a cartridge is placed between the two rails for re-sizing. FIG. 3 shows the cartridge re-sizing machine midway through the operational cycle of the cartridge rolling process.

Referring to FIG. 2, base 30 includes floor 32 and a pair of walls which extend above floor 32. Base 30 may be fabricated from cast aluminum. Wall 34 shown on the left is generally in parallel opposition to wall 36 shown on the right. Cartridge feed platform 44 is affixed to the upper portion of wall 34. A mounting block for the drive assembly 120 is affixed to the outer side of right wall 36 (not shown).

Floor filler plates 38 and 40 are disposed on floor 32 to form keyway 42. Floor filler plate left 38 is positioned adjacent to left wall 34 and is spaced apart from floor filler plate right 40, which is adjacent to wall 36. Preferably, key way 42 extends parallel to wall 34 and wall 36.

Slide 50 is positioned on a floor filler plates 38 and 40. Key 52, which is affixed to the lower side of slide 50 is adapted to engage key way 42 and allow slide 50 to reciprocally move parallel to walls 34 and 36. Preferably, both filler plates 38 and 40 and slide 50 are made from hardened steel inasmuch as these elements provide the rigidity necessary to maintain the forming rails in the desired position. Slide 50 includes cut-out 56 in which moving (back-up) forming rail 70 is removably affixed. Moving back-up forming rail 70 is oriented to face toward static forming rail 90, described below. Cartridge feed cam follower 58 is mounted on the top surface of slide 50 and is adapted to cooperate with the cartridge feed assembly 140, described below, to load cartridges into the machine. Right cover rail 60 and left cover rail 62 retain slide 50 within walls 34 and 36 on floor filler plates 38 and 40.

Forming rail 70 includes a forming surface 72 which extends from cartridge pick-up end 74 where the cartridge to be re-sized is picked up to finishing end 76 at which the re-sized cartridge is discharged.

Cartridge pick-up pocket 84 is positioned in forming surface 72 at the cartridge pick-up end 74 of forming rail 70. Cartridge pick-up pocket 84 is a vertically disposed notch adapted to receive a cartridge for re-sizing from the cartridge feed assembly 140 described below. Inclined step 86 is positioned on the forming surface 72 of rail 70. Step 86 begins at cartridge pick-up pocket 84 and extends the length of rail 70 to the finishing end 76 of forming rail. The lowest point of step 86 is within the extractor groove 16 of the cartridge which engages rib 94 of static forming rail 90. Step 86 inclines upwardly, over the length of rail 70, to the top of rail 70 at finishing end 76. The inclined step 86 serves to engage the neck of the cartridge at cartridge pick-up pocket 84.

The cartridge re-sizing machine preferably rotates the cartridge at least three turns as it travels between the forming rails 70 and 90. During the rotation of the cartridge, the inclined step 86 engages the neck 18 of the cartridge adjacent to extractor groove 16 and as the bulge in the neck is compressed by forming rails 70 and 90, the excess cartridge material from the bulge is moved upwardly along the neck of the cartridge, thus increasing the overall length of the cartridge during the re-sizing operation.

The step 86 is considered essential to carry out the objectives of the present invention inasmuch as it is believed that re-sizing the cartridge to the correct diameter without increasing the length is not sufficient to meet the S.A.M.I. specifications for reloadable ammunition.

Figure 4B:
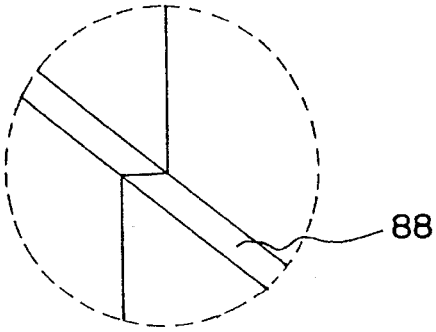
FIG. 4 is an isometric view of the moving forming rail showing the inclined step.
Figure 4A:
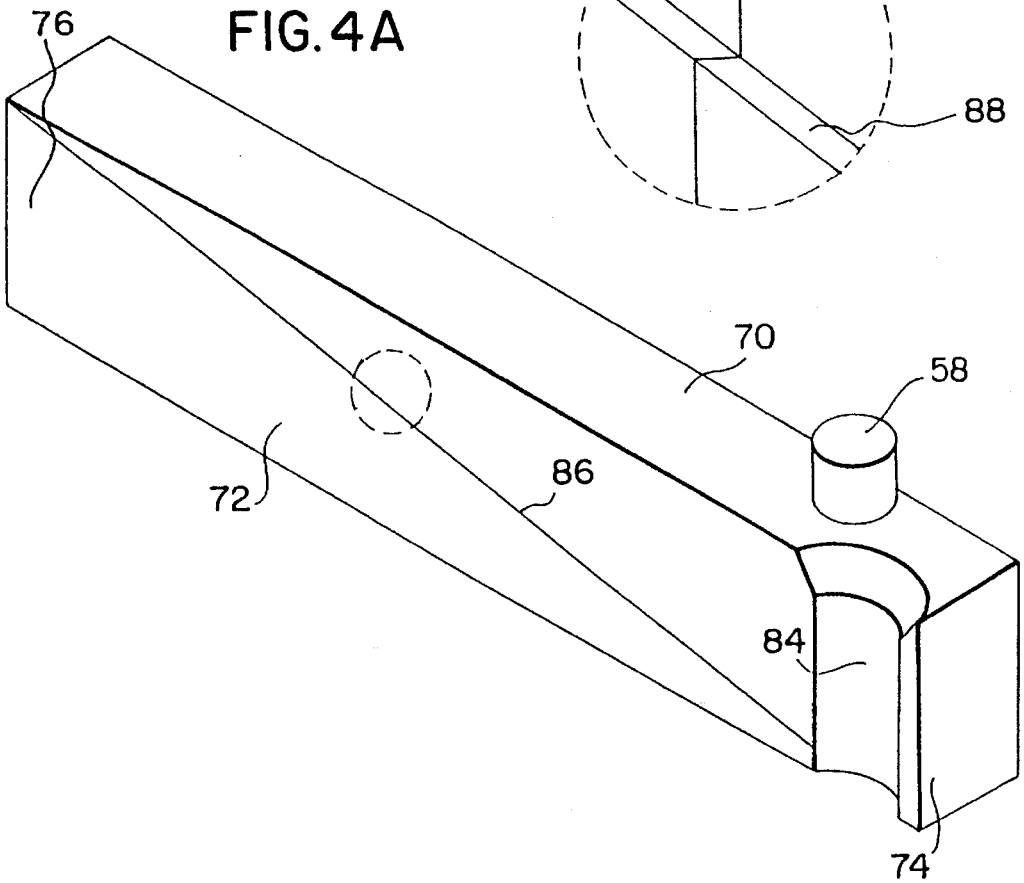
Figure 5:
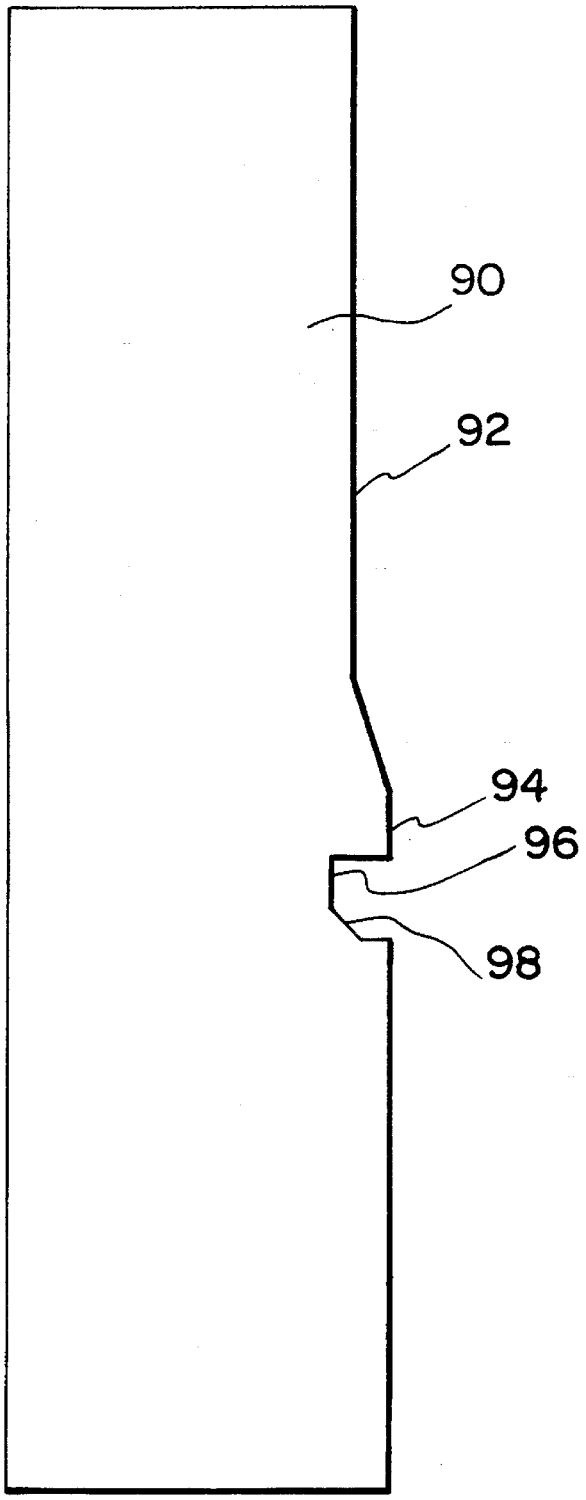
FIG. 5 is a cross-sectional view of the static forming rail.

The off-set 88 of inclined step 86, as shown in the detailed enlargement of FIG. 4, is preferably about 0.005 inches in deep which has been found to be enough to cause the lengthening of the cartridge. Alternatively, the depth of this step off-set 88 may be from 0.005 to 0.010 inches. Preferably, the edge of the step at the off-set 88 is radiused to avoid scratching the cartridge as it is lengthened during the re-sizing operation.

Static forming rail 90 is removably affixed to left wall 36 in a position opposing moving rail 70 and parallel to the movement of slide 50. Forming surface 92 of static forming rail 90 includes a rib 94, recess 96, and chamfer 98 thus providing a silhouette complementary to the cartridge which is adapted to engage the cartridge extractor groove and rim. The silhouette in forming surface 92 is adapted to maintain the cartridge in the desired position at the desired level throughout the rolling operation.

Drive assembly 120 functions to reciprocally cycle slide 50 from the cartridge pick-up position through the rolling operation to the finish position, and then back to the pick-up position. Drive assembly 120 includes handle shaft 122 to which handle knob 124 is affixed. Handle shaft 122 slides through handle slide/pivot 130 which is affixed to slide 50 through drive handle pivot assembly 54. The drive assembly 120 is affixed to the outside of right wall 36 of base 30 through handle mounting block (not shown). Movement of handle knob 124 in a direction parallel with the direction of movement of slide 50 causes slide 50 to move as handle shaft 122 slides through handle slide pivot 130.

Figure 6:
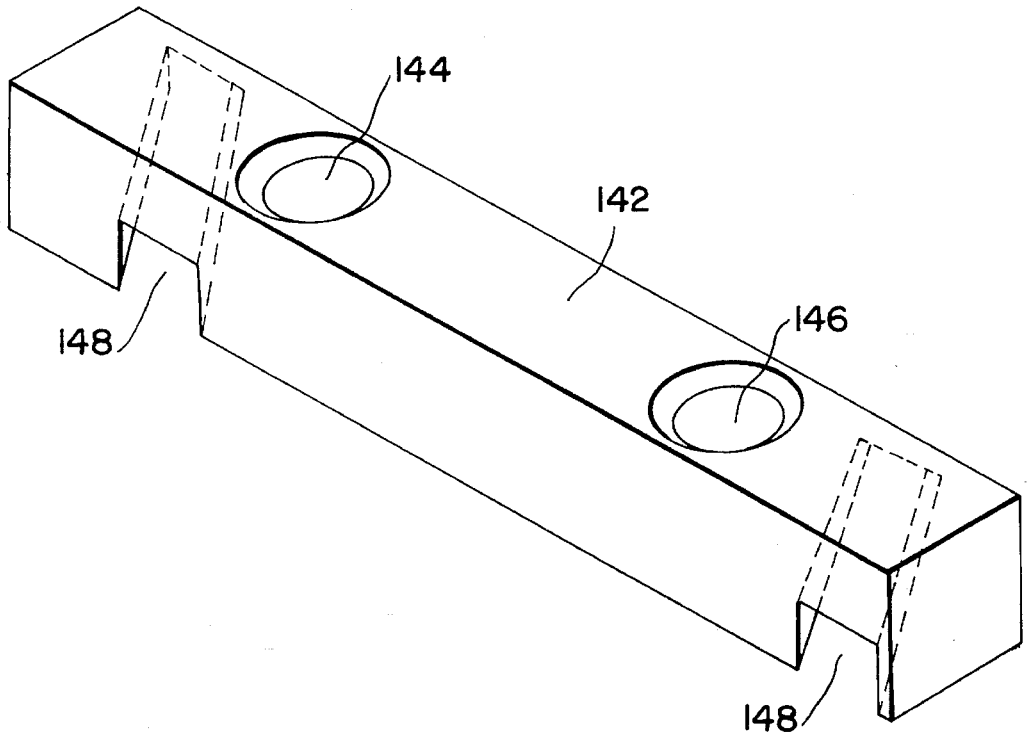
FIG. 6 is an isometric view of the cartridge feed slide bar.

The cartridge feed assembly 140 functions to provide a supply of used cartridges to the re-sizing machine and position cartridges one at a time, between the forming rails 70 and 90 in cartridge pick-up pocket 84. The cartridge feed assembly 140 includes feed slide bar 142 which includes cartridge opening 144 and cam slots 148. In the preferred embodiment, the feed slide bar 142 has a small opening 144 for small cartridges and a large opening 146 for large cartridges. The feed slide bar 142 also includes two cam slots 148. The feed slide bar 142 may be reversed to accommodate both large and small cartridges. Cam slots 148 is shown in phantom in FIG. 6. Cam slots 148 cooperate with cartridge feed cam follower 58 mounted on slide 50 so that when the slide is moved to the cartridge pick-up position, the feed slide bar 142 carries a cartridge in opening 144 or 146 to the space above the cartridge pick-up position, dropping a cartridge between the forming rails 70 and 90 in order to undergo the re-sizing operation. Feed tube 150 functions as a reservoir for cartridges to be re-sized. When the slide moves into the rolling position, cam follower 58 causes slide bar 142 to move feed opening 144 beneath feed tube 150 to pick-up a cartridge to be re-sized.

The forming rails at the cartridge pick-up position are spaced apart a distance greater than the specified diameter of the cartridge being re-sized. The spacing between the forming rails diminishes gradually as the slide moves the moving forming rail through the sizing cycle so that at the cartridge finishing position, the rails are spaced apart the diameter specified by S.A.M.I. for the cartridge being re-sized. It has been found that spacing the rails at the cartridge pick-up point about 0.010 inches greater than the S.A.M.I. specified diameter provides sufficient taper. Although the reduction in the spacing between the rails may be accomplished by a variety of mechanisms, in the present invention, it is preferred that one of the rails be thicker at the cartridge finishing end than the cartridge pick-up end, whereby the space between the rails diminishes as the slide is moved from the cartridge pick-up position to the cartridge finish position.

In the embodiment shown hereinabove, the moving forming rail 70 is somewhat thicker at the finishing end than at the pick-up end. However, the present invention contemplates forming the static forming rail 90 with a bigger portion. Alternatively, the slide key way 42 may be arranged in such a manner to reduce the spacing of the forming rails during the re-sizing cycle.

Generally, it is desired to have the moving forming rail 70 somewhat longer than static forming rail 90 to allow a cartridge pick-up pocket 84 in moving rail 70 to move beneath cartridge opening 144 before the cartridge is moved between forming rails 70 and 90. It has been found that a moving rail 70 of about five inches long operated with a static rail 90 of about three inches length is adequate to re-size ammunition for widely used pistol target shooting, such as 9–10 mm ammunition.

Moving forming rail 70 and static forming rail 90 are preferably removably affixed to the re-sizing machine, so that alternative forming rails having different silhouettes and spacing can be used to re-size different types of cartridges.

The cartridge re-sizing machine described herein is shown in a manually operated embodiment, although the present invention contemplates that the machine could be motor driven as well. Although the preferred embodiment of the present invention is the linear forming rails described, the present invention contemplates a cylindrical configuration cartridge re-sizing machine wherein the moving forming rail rotates with respect to the static forming rail.

The forms of invention herein shown and described are to be considered only illustrative. It will be apparent to those skilled in the art that numerous modifications may be made therein without departing from the spirit of the invention or the scope of the appended claims.

I claim:

1. A machine for re-sizing a used ammunition cartridge, said cartridge having an extractor groove and a cartridge neck adjacent said extractor groove, said cartridge neck having an upper end, said machine comprising:

a base, a static forming rail having a forming face, said static forming rail mounted on said base, a moving forming rail having a forming face, said moving forming rail being slidably mounted on said base, said forming rails being positioned with said forming surfaces facing one another;

a drive assembly mounted on said base, said drive assembly reciprocally moving said moving forming rail with respect to said static forming rail from a cartridge pick-up position in a direction parallel to said static-forming rail to a cartridge finish position;

said forming rails being spaced apart the specified diameter of the cartridge at said cartridge finish position and being spaced a greater distance apart at said cartridge pick-up position;

at least one of said forming rails having a forming surface including a silhouette to approximate the silhouette of a cartridge to be re-sized, said silhouette engaging a cartridge to be re-sized and maintain the cartridge between said forming rails; and one of said forming rails including an inclined step beginning at the cartridge pick-up point at the cartridge extractor groove and ascending to the cartridge finish position at the upper end of said cartridge neck, whereby said inclined step engages the neck of a cartridge as it is being re-sized to increase the length of said cartridge as said cartridge is rolled between said forming rails.

2. The machine as described in claim 1, wherein said rails are removably mounted.

3. The machine as described in claim 1, wherein the forming surface of said static forming rail includes said silhouette.

4. The machine as described in claim 1, wherein the forming surface of said moving forming rail includes said inclined step.

5. The machine as described in claim 1, wherein one of said rails is thicker at the cartridge finish end than the cartridge pick-up end.

6. The machine as described in claim 1, wherein said drive assembly is manually powered.

7. The machine as described in claim 1, wherein said forming rails are linear.

8. The machine as described in claim 1, which includes a cartridge feed assembly including a slide bar which receives a cartridge to be re-sized, said slide bar positioned to slide normal to said rails, said slide bar having a cam slot, activated by movement of a cam follower associated with said moving forming rail to carry a cartridge to be re-sized to a point above the cartridge pick-up position between said forming rails.

9. The machine as described in claim 8, wherein said slide bar has an opening to receive a cartridge to be re-sized.

10. The machine described in claim 8, wherein said slide bar has more than one opening to receive cartridges of different sizes for re-sizing.

* * * * *